US005482070A

United States Patent [19]

Kelly

[11] Patent Number: 5,482,070

[45] Date of Patent: Jan. 9, 1996

[54] COMBINED ADJUSTABLE CRUTCH AND CANE

[76] Inventor: James V. Kelly, 2617 Amarillo Blvd. East, Amarillo, Tex. 79107

[21] Appl. No.: 317,481

[22] Filed: Oct. 4, 1994

[51] Int. Cl.[6] ..... A61H 3/02

[52] U.S. Cl. ..... 135/66; 135/68; 135/72; 135/75

[58] Field of Search ..... 135/66, 68, 69, 135/71, 72, 75, 76

[56] References Cited

U.S. PATENT DOCUMENTS

| | | | |
|---|---|---|---|
| 869,128 | 10/1907 | Autenrieth | 135/66 X |
| 2,590,607 | 3/1952 | Grimball | 135/69 |
| 2,630,128 | 3/1953 | Slater | 135/69 |
| 2,960,095 | 11/1960 | Smith, Jr. | 135/68 |
| 3,208,461 | 9/1965 | Irwin | 135/69 |
| 4,407,318 | 10/1983 | Stuever | 135/66 |
| 4,917,126 | 4/1990 | Ellmore | 135/75 X |
| 5,139,040 | 8/1992 | Kelly | 135/75 X |
| 5,149,092 | 9/1992 | Parsons | 135/75 X |
| 5,201,334 | 4/1993 | Tseng | 135/72 X |
| 5,351,701 | 10/1994 | Hsiao | 135/75 X |

*Primary Examiner*—Wynn E. Wood
*Attorney, Agent, or Firm*—C. J. Husar

[57] ABSTRACT

The disclosure relates to a convertible adjustable crutch/cane which is initially used as a crutch and subsequently used as a cane after the need for a crutch no longer exists. The crutch/cane includes a novel connector hand/grip support that is made of lightweight, high strength molded plastic. The connector hand/grip eliminates the need for complicated metal working steps previously required in known prior art devices. Additionally, there is disclosed a novel underarm support which is economical to produce requiring a minimum amount of material and is useful in a single support crutch.

13 Claims, 1 Drawing Sheet

COMBINED ADJUSTABLE CRUTCH AND CANE

BACKGROUND OF THE INVENTION

This application is related to improvements of applicant's Collapsible Lightweight Crutch identified as U.S. Pat. No. 5,139,040 issued on Aug. 18, 1992. The instant application includes a novel hand grip connector which interconnects the hand grip and provides support for the telescoping elements of the adjustable crutch. In the aforementioned patent it has been found that the manufacturing steps required for making the hand grip and attaching it to the middle member of the three component crutch have been rather expensive to execute. Firstly, the hand grip had to be deformed to provide a curved attaching surface and then rolled to a ninety-degree angle for attachment and subsequently permanently attached to the middle member of the three component crutch. The attachment was performed by welding or brazing which are delicate operations when working with aluminum tubing components. Each of these steps is a labor intensive step resulting in prohibitive costs.

In view of the above noted problems, applicant has developed a novel unitary connector and hand grip which eliminates the need for rolling, bending and welding to provide the hand grip support. More specifically, applicant has developed a unitary high strength plastic connector and hand grip which supports the hand grip and also provides vertical support for the middle and upper members of the three member adjustable collapsible crutch.

Further, applicant has developed an under arm support which is also made of high strength plastic which includes a plurality of supporting ribs and requires a minimum amount of plastic in the manufacturing process. The under arm support includes an anti-rotation stop member which is integrally molded into a central bore of the under arm support and cooperates with a corresponding slot in the uppermost end of the upper member of the three component adjustable crutch.

In addition to the above noted improvements, applicant's novel connector and hand grip also provides a means whereby the collapsible adjustable crutch can be converted to a walking cane after the patient's need for a crutch has ceased. Applicant's novel crutch and cane allows the uppermost member of the three telescopic members to be removed and allows a plug-type cap to be inserted therein to permit its use as a walking cane. In the cane mode, there remains the adjustable length feature which was present during use as a crutch.

The instant improvements retain the safety features set forth in my earlier patent, i.e. the release pin sleeve which comprises an internal sleeve in each of the adjustable release pin areas which prevent "hang-up" of the release pin when making a length adjustment and insures positive re-engagement of the release pin after an adjustment has been made.

OBJECTS OF THE INVENTION

An object of the invention is to provide a crutch having a novel connector and hand grip which interconnects the upper two members and provides support therefor.

Another object of the invention is to provide a hand grip connector which is made of molded high strength plastic which eliminates the need for a series of metal working steps.

A further object of the invention is to provide an under arm support which is made of high strength plastic.

Yet another object of the invention is to provide an under arm support which requires a minimum amount of plastic in the molding process.

A still further object of the invention is to provide an under arm support which includes an anti-rotation feature.

Another object of the invention is to provide a collapsible adjustable crutch which is convertible to a walking cane.

These and other objects of the instant invention will become more apparent hereinafter. The invention will now be described with particular reference to the accompanying drawings which form a part of this specification wherein like reference characters designate the corresponding parts in the several views.

DETAILED DESCRIPTION OF THE DRAWINGS

Figure 1:
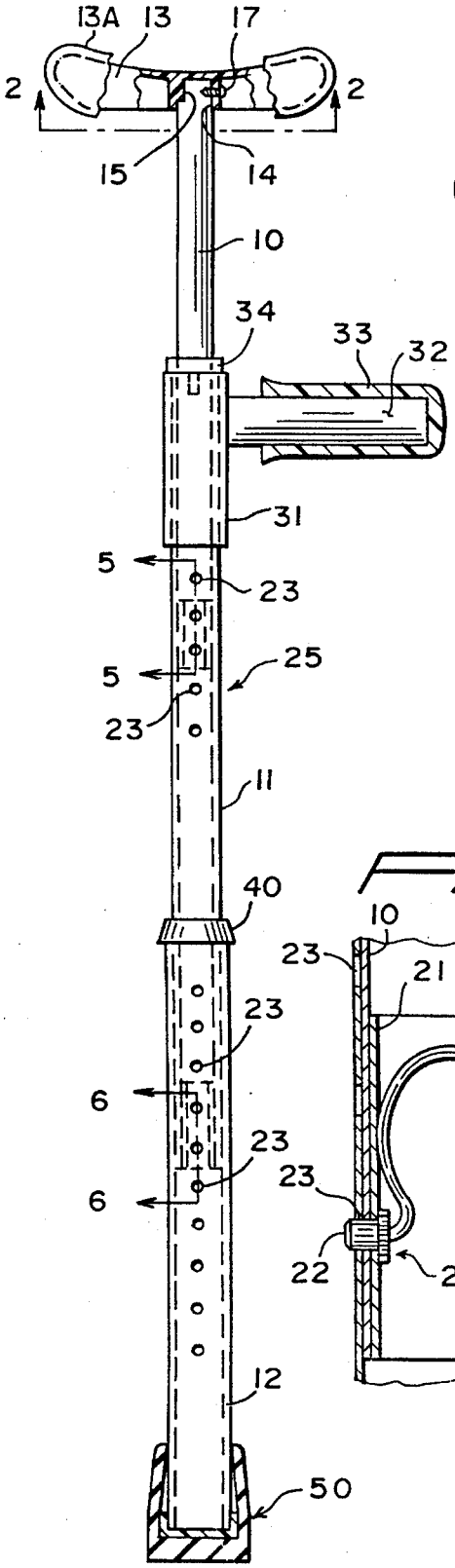
FIG. 1 is an elevational view of the adjustable crutch.

Referring now to FIG. 1, there is shown the convertible adjustable crutch and cane indicated generally by reference numeral 25. As illustrated, convertible crutch and cane 25 includes three telescoping members 10, 11, 12, which comprise the upper, middle and lower tubular members, respectively. Middle tubular member 11 receives upper tubular member 10 and middle tubular member 11 is received in lower member 12. All three tubular members 10, 11 and 12 are made of lightweight, high strength aluminum. Attached to the terminal end of upper tubular member 10 is under arm support 13 which includes a central bore for receiving upper tubular member 10. Padded cover 13A is shown in broken-away fashion to illustrate the details of under arm support 13. As shown under arm support 13 includes an integral lug or projection 15 which cooperates with a slot 16 in upper tubular member 10 to prevent relative rotation therebetween. Additionally, a screw 17 is provided diametrically opposite to lug 15 and further serves to prevent relative rotation between upper tubular member 10 and under arm support 13. As indicated above, the lowermost end of upper tubular member 10 is telescopically received in middle tubular member 11.

Attached to the upper terminal end of middle tubular member 11 is applicant's novel connector and hand grip support 30. The connection between these two members is by a tight friction fit therebetween. However, additional attachment means such as a set screw (not shown) may be added if found necessary. As shown, connector and hand grip support 30 includes a cylindrical portion 31 of a given diameter to snugly receive middle tubular member 11. Additionally, connector and hand grip support 30 includes an integrally formed tubular portion 32 which extends perpendicularly from the upper outer surface of cylindrical portion 31 and receives a rubber grip 33 thereof. The uppermost end of connector and hand grip support 30 includes an integral collar 34, the details of which will be explained in the discussion of FIG. 3. The uppermost end of lower tubular member 12 is provided with a collar 40 to ensure a snug fit of tubular members 11 and 12. The lowermost end of lower tublular member 12 is provided with a shock absorbing tip 50 made of rubber or other suitable material.

Figure 2:
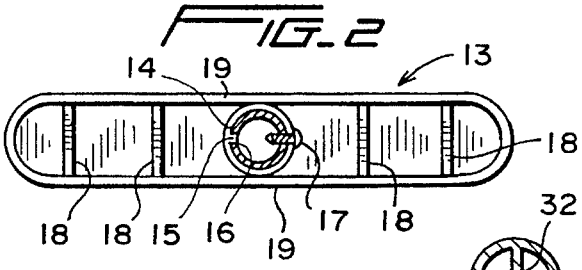
FIG. 2 is a sectional view taken on the plane 2—2 of FIG. 1.

Turning now to FIG. 2, there is shown a sectional view taken along the plane 2—2 of FIG. 1 illustrating the underside of under arm suppport 13. Under arm support 13 is provided with a plurality of reinforcing ribs 18 which interconnect with longitudinal edges 19 to provide reinforcement to under arm support 13. As shown in the broken-away portion of FIG. 1, the underside of under arm support 13 is hollow except for ribs 18 and central bore 14. The purpose of this construction is to reduce the amount of plastic reqired in the molding process while maintaining high structural integrity of under arm support 13 due to the high strength plastic material utilized. As shown in FIG. 1, under arm support 13 is provided with a pad or cover 13A which is shown in broken-away fashion to provide comfort to the user. Additionally, there is shown, a projection or lug 15 which is integral with central bore 14 and cooperates with slot 16 in upper tubular member 10 to prevent rotation of under arm support 13 relative to upper tubular member 10. Further, there is shown a screw 17 which penetrates the wall of central bore 14 and upper tubular member 10 to provide an additional measure of protection againt any undesired rotation between these two elements. As indicated above, under arm support 13 is made by injection molding or any other suitable process utilizing high strength durable plastic. Due to its unique design, a minimum amount of plastic material is required thus reducing its manufacturing costs while :maintaining its high structural strength.

Figure 3:
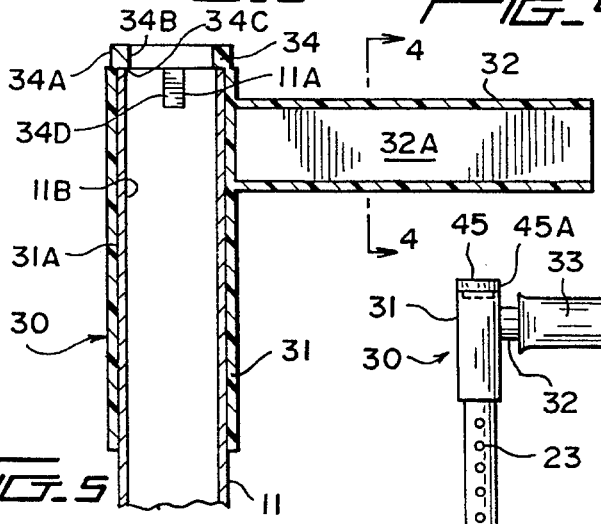
FIG. 3 is a detailed view of the hand grip connector per se.

Turning now to FIG. 3, there is shown in cross-section, applicant's novel connector and hand grip support 30. As mentioned above, connector and hand grip 30 provides two important and useful functions. Firstly, it provides support for the hand grip 32 and simultaneously provides the connection means for hand grip 32 relative to the middle tubular member 11 and also upper tubular member 10. Connector and hand grip 30 includes a vertically extending cylindrical portion 31 having an internal diameter 31A which snugly receives middle tubular member 11. If found necessary, a set screw (not shown) may be utilized to secure middle tubular member 11 to connector and hand grip spport 30. An integrally formed collar portion 34 is located on the upper terminal end of cylindrical portion 31. As shown, collar portion 34 has an outer diameter 34A which is slightly less than the outer diameter of middle tubular member 11 and an inner diameter 34B which is less than the internal diameter 11B of middle tubular member 11. Internal diameter 34B, shown in exaggerated form, is actually only a few thousandths of an inch less than internal diameter 11B of middle tubular member 11 to ensure a snug fit of upper tubular member 10 therein. Integral collar 34 includes a shoulder portion 34C which serves as an abutment or stop for preventing further upward movement of middle tubular member 11 relative to connector and hand grip support 30. Further, cylindrical portion 31 includes a pair of oppositely disposed anti-rotation lugs 34D, only one of which is visible, which cooperates with cut-out slots 11A, only one of which is visible, of middle tubular member 11 to prevent relative rotation therebetween. A set screw (not shown) may also be used to attach connector and hand grip 30 to middle tubular member 11 if found necessary. Integral with and extending perpendicular to cylindrical portion 31 is the hand grip support 32 which includes strut 32A to provide additional strength thereto. Although shown in FIG. 3, outer rubber grip 33 has not been installed thereover in this view.

Figure 4:
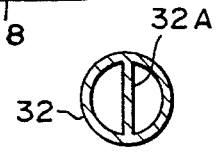
FIG. 4 is a sectional view of the hand grip taken on the plane 4—4.

Referring now to FIG. 4, there is shown a cross-sectional view of hand grip support 32 which basically is tubular in configuration and includes a supporting rib 32A which extends across the internal diameter thereof to provide added support.

Figure 5:
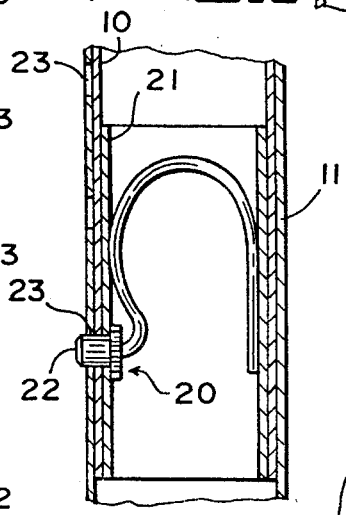
FIG. 5 is a sectional view taken on the plane 5—5 of FIG. 1 showing the upper release pin and release pin sleeve.

FIG. 5 is a sectional view taken along plane 5—5 of FIG. 1 which illustrates upper release pin assembly 20 and includes release pin sleeve 21 which is attached to the internal diameter and lowermost end of upper tubular member 10. Release pin assembly 20 and release pin sleeve 21 cooperate to provide the same safety features as set forth in my earlier patent which is hereby incorporated by reference. As indicated in my earlier patent, release pin sleeve 21 prevents "hang-up" of release pin 22 when making a length adjustment and ensures its return to the desired adjustment aperture 23.

Figure 6:
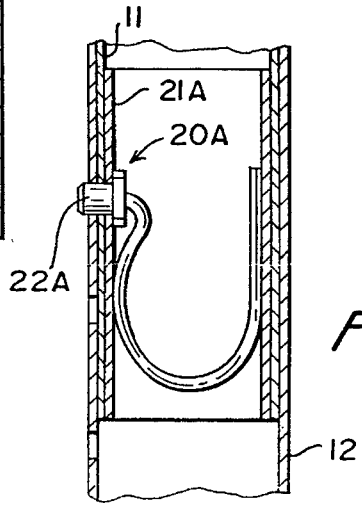
FIG. 6 is a sectional view taken on the plane 6—6 of FIG. 1 showing the lower release pin and release pin sleeve.

FIG. 6 is a sectional view taken along the plane 6—6 of FIG. 1 which illustrates the lower release pin assembly 20A. Inasmuch as the release pin assemblies are not part of the instant invention, further discussion is not necessary. However, for the sake of completeness, reference is again made to my earlier patent.

Figure 7:
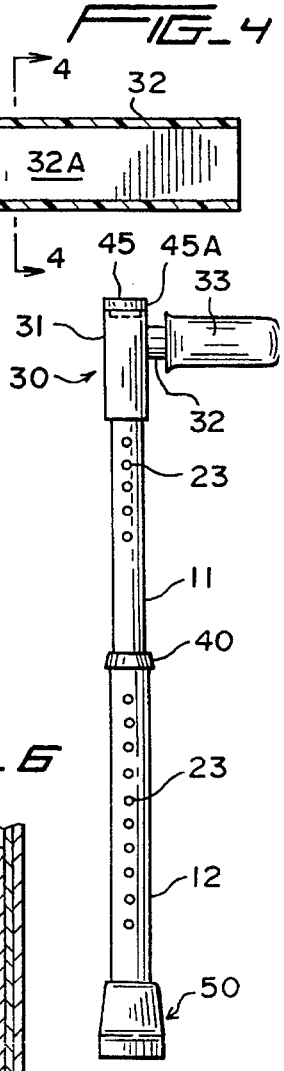
FIG. 7 is an elevational view with the upper crutch member removed illustrating its use as an adjustable cane.

Turning now to FIG. 7, there is shown in elevation, the cane mode of applicant's combined crutch and cane. In this mode, upper tubular member 10 has been removed from connector and hand grip 30 and plug 45 has been inserted into inner diamemter 34B of integral collar 34. Plug 45 has an outer diameter 45A which conforms to the outer diameter of cylindrical portion 31 thus providing a smooth neat appearance to the cane. As indicated earlier, the cane mode is used after the user has sufficiently recovered and regained sufficient strength and no longer requires the use of a crutch however still desires the measure of safety and comfort provided by using a cane.

By way of review, it is pointed out that applicant's novel under arm support 13 and connector and hand grip 30 provide an economical and structurally sound combined crutch and cane which takes advantage of new technologies to reduce the overall weight and costs of producing the combined crutch and cane. Additionally, applicant has provided a system whereby the crutch can be readily and conveniently converted to a cane after the need for a crutch no longer exists.

While the invention has been described in its preferred embodiment, it is to be understood that the words which have been used are words of description rather than limitation and that changes may be made without departing from the full scope or spirit of the invention.

Having thus described my invention, I claim:

1. A combined adjustable crutch and cane comprising:

an upper, middle and lower tubular member arranged in telescopic relation;

each of said upper, middle and lower tubular members having an upper and lower terminal end;

a unitary one-piece connector and hand grip support means including an integral collar fixedly secured thereto said integral collar having an upper and lower end, said lower end of said collar receiving said upper terminal end of said middle tubular member said upper end of said collar receiving said lower terminal end of said upper tubular member;

under arm support means operably connected to said upper terminal end of said upper tubular member;

adjustment means allowing vertical height adjustments of said upper tubular member relative to said middle tubular member and said lower tubular member relative to said middle tubular member;

said under arm support means and said unitary one-piece connector and hand grip support means each including anti-rotation means on inner surfaces thereof for preventing relative rotation between the respective tubular members the upper tubular member being removable from said unitary one-piece connector and hand grip support means such that insertion of a plug therein said upper end of said integral collar converts said adjustable crutch to a cane.

2. A combined adjustable crutch and cane as defined in claim 1 wherein said middle tubular member receives said upper tubular member in an uppermost end and said lower tubular member receives the lowermost end of said middle tubular member;

said lower tubular member having a lower terminal end, said lower tubular member including a shock absorbing tip mounted on its lower terminal end to absorb shock when in use.

3. A combined adjustable crutch and cane as defined in claim 1 wherein said connector and hand grip support means comprises a first cylindrical portion having said integral collar portion at an uppermost end thereof;

said cylindrical portion having a particular inner and outer diameter while said integral collar portion has a lesser inner and outer diameter, both said inner diameters providing a snug fit for said upper and middle tubular members when received therein;

said integral collar portion having a shoulder portion which extends over said inner diamemter of said cylindrical portion to serve as a vertical abutment for said middle tubular member when inserted therein.

4. A combined adjustable crutch and cane as defined in claim 3 wherein said anti-rotation means comprises a lug integrally formed on said inner diameter of said cylindrical portion of said connector and hand grip suppport means and a slot in said upper terminal end of said middle tubular member whereby said slot and said lug cooperate to prevent relative rotation therebetween.

5. A combined adjustable crutch and cane as defined in claim 3 wherein said connector and hand grip support is made of high strength molded plastic material and further includes an integrally formed hand grip support which extends at a right angle to said cylindrical portion.

6. A combined adjustable crutch and cane as defined in claim 1 wherein said underarm support means is molded of high strength plastic material and is provided with a centrally located bore for receiving said upper tubular member;

said underarm support means further including a plurality of spaced strengthening ribs which are integrally molded into said underarm support means to reduce the amount of plastic material required while providing a high strength under arm support.

7. A combined adjustable crutch and cane as defined in claim 6 wherein said centrally located bore of said under arm support means includes an integrally formed lug and said upper tubular member is provided with a slot at said upper terminal end whereby said lug and said slot serve to prevent rotation between said underarm support and said upper tubular means.

8. A combined adjustable crutch and cane as defined in claim 1 wherein said upper, middle and lower tubular members are made of lightweight aluminum to reduce the overall weight of said combined adjustable crutch and cane.

9. An adjustable cane comprising a first and second tubular member arranged in telescopic relation;

each of said first and second tubular members having an upper and lower terminal end;

a unitary one-piece connector and hand grip securely attached to said upper terminal end of said first tubular member;

said unitary one-piece connector and hand grip including a first cylindrical portion which receives said upper terminal end of said first tubular member and an integral collar portion including a shoulder portion providing a vertical abutment with said first tubular member;

anti-rotation means comprising at least one lug and cooperating slot for preventing relative rotation between said connector and grip and said first tubular member;

said unitary one-piece connector and hand grip means further including a hand grip support portion which comprises a horizontally extending portion which extends from said first cylindrical portion whereby said telescopic members can be adjusted vertically to provide a comfortable cane for the user.

10. An adjustable cane as defined in claim 9 wherein said connector and hand grip is made of molded high strength plastic material and further includes a rubber grip which is received by said hand grip support to provide a comfortable grip to the user.

11. A unitary one-piece connector and hand grip support for use in a convertible walking aid comprising:

an elongated cylindrical connector portion having an inner diameter and an outer diameter spaced about a longitudinal axis for receiving a plurality of telescopic members disposed along said longitudinal axis;

an integral hand grip portion extending from said outer diameter perpendicular to said longitudinal axis of said elongated cylindrical portion;

anti-rotation means comprising at least one lug on an uppermost end of said inner diameter and extending inward therefrom and a cooperating slot in a walking aid component for receiving said at least one lug to prevent relative rotation between said elongated cylindrical connector portion and a walking aid component;

an integral collar located at said uppermost end of said elongated cylindrical portion for receiving a component of said walking aid, said integral collar including a shoulder portion providing a vertical abutment for said walking aid component.

12. A connector and hand grip support as defined in claim 11 wherein said entire unit is made of molded lightweight, high strength plastic material.

13. A unitary one-piece connector and hand grip support as defined in claim 11 wherein said integral hand grip comprises a cylindrical extension of said elongated cylindrical connector portion, said cylindrical extension having an inner diameter and further includes a supporting rib extending across said inner diameter of said cylindrical extension to provide added strength and rigidity.

* * * * *